US006917168B2

(12) United States Patent
Sakurai et al.

(10) Patent No.: US 6,917,168 B2
(45) Date of Patent: Jul. 12, 2005

(54) CATHODE RAY TUBE DEVICE AND A TELEVISION SET USING THE SAME

(75) Inventors: Souichi Sakurai, Yokohama (JP); Takanori Hisada, Yokohama (JP); Sakae Watanabe, Mutsuzawa (JP)

(73) Assignee: Hitachi Displays, Ltd., Mobara (JP)

( * ) Notice: Subject to any disclaimer, the term of this patent is extended or adjusted under 35 U.S.C. 154(b) by 36 days.

(21) Appl. No.: 10/718,965

(22) Filed: Nov. 21, 2003

(65) Prior Publication Data

US 2004/0155611 A1 Aug. 12, 2004

(30) Foreign Application Priority Data

Dec. 20, 2002 (JP) ..... 2002-369173

(51) Int. Cl.[7] ..... H01J 29/51

(52) U.S. Cl. ..... 315/368.25; 315/368.28; 313/439; 313/440

(58) Field of Search ..... 315/368.25, 375, 315/376, 368.28; 313/440, 439

(56) References Cited

U.S. PATENT DOCUMENTS 3,714,500 A * 1/1973 Kaashoek ..... 315/368.18
5,260,627 A * 11/1993 Yokota et al. ..... 315/400
5,592,045 A 1/1997 Dossot et al.

FOREIGN PATENT DOCUMENTS

| | | |
|---|---|---|
| JP | U-5-33448 | 4/1993 |
| JP | A-5217517 | 8/1993 |
| JP | A-8-50868 | 2/1996 |
| JP | A-9-182098 | 7/1997 |
| JP | A-10-255689 | 9/1998 |

* cited by examiner

*Primary Examiner*—David Vu
(74) *Attorney, Agent, or Firm*—Townsend and Townsend and Crew LLP

(57) ABSTRACT

Sensitivity of a velocity modulation device is increased and noise such as a leakage magnetic field and a leakage electric field from the device are reduced to thereby lower power consumed by the device. A cathode ray tube device and a television set each include a velocity modulation device on a cathode side of a deflection yoke. All or part of the circumference of a velocity modulation coil to modulate scan beam velocity is covered with material having an initial permeability of at least 10 at 2 MHz.

9 Claims, 5 Drawing Sheets

CATHODE RAY TUBE DEVICE AND A TELEVISION SET USING THE SAME

BACKGROUND OF THE INVENTION

The present invention relates to a cathode ray tube device and a television set using the same.

Velocity modulation devices of the prior art associated with the present invention include a velocity modulation device including a bobbin made of a molding material such as a plastic material to hold a velocity modulation coil and a main body of the VM coil in a rectangular shape as shown in FIGS. 1, 2, 3, and 9 of JP-A-10-255689; a velocity modulation device including a two-pole, four-pole, or six-pole convergence magnet in the periphery or circumference of the coil as shown in FIG. 3 of JP-A-9-182098; and a velocity modulation device including, for example, a printed coil to increase sensitivity of the coil as shown in FIGS. 3 and 4 of U.S. Pat. No. 5,592,045 (JP-A-8-50868).

SUMMARY OF THE INVENTION

The present invention relates to a cathode ray tube device including an electron gun operating only according to electrostatic focusing and a velocity modulation (VM) coil to modulate scanning beam velocity, and in particular, to a technique to increase sensitivity of the velocity modulation coil and to suppress a leakage magnetic field from the coil.

Ordinarily, the velocity modulation coil has a primary function to change a deflection scanning speed of an electron beam mainly in the horizontal direction according to intensity of video signals to thereby increase sharpness of a screen image. Therefore, the velocity modulation device must operate in a wide band covering video frequencies. Since the velocity modulation coil is arranged over the electron gun, there arises a problem of deterioration in the effective sensitivity due to adverse influence of an eddy current of the electron gun. The velocity modulation device operates with high power in a wide band and hence consumes a relatively large amount of power. This leads to a problem of occurrence of noise such as a leakage magnetic field and a leakage electric field.

It is therefore an object of the present invention, which has been devised to solve the problem using quite a simple configuration, to provide a technique which increases sensitivity of a velocity modulation device and which also reduces noise such as a leakage magnetic field and a leakage electric field from the velocity modulation device to thereby minimize consumption power consumed by the device.

To achieve the object according to one aspect of the present invention, there is provided a velocity modulation device in which all or part of an entire circumference of a velocity modulation coil to modulate scanning beam velocity is covered with material having initial permeability of at least 10 at 2 MHz is arranged on a cathode side of a deflection yoke. Alternatively, there is provided a velocity modulation device in which a toroidally wound velocity modulation coil to modulate a scanning beam velocity and a core of the coil made of material having initial permeability of at least 10 at 2 MHz is arranged on a cathode side of the auxiliary deflection yoke.

BRIEF DESCRIPTION OF THE DRAWINGS

These and other features, objects and advantages of the present invention will become more apparent from the following description when taken in conjunction with the accompanying drawings wherein.

DESCRIPTION OF THE EMBODIMENTS

While we will show and describe several embodiments in accordance with our invention, it should be understood that disclosed embodiments are susceptible of changes and modifications without departing from the scope of the invention. Therefore, we do not intend to be bound by the details shown and described herein but intend to cover all such changes and modifications a fall within the ambit of the appended claims.

Figure 1:
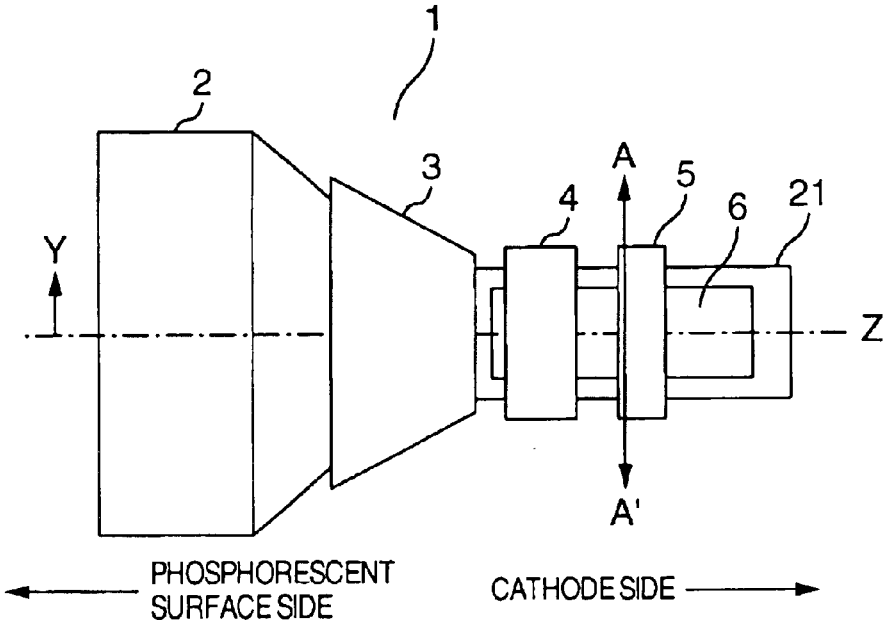
FIG. 1 is a side view of a cathode ray tube device according to the present invention.
Figure 2:
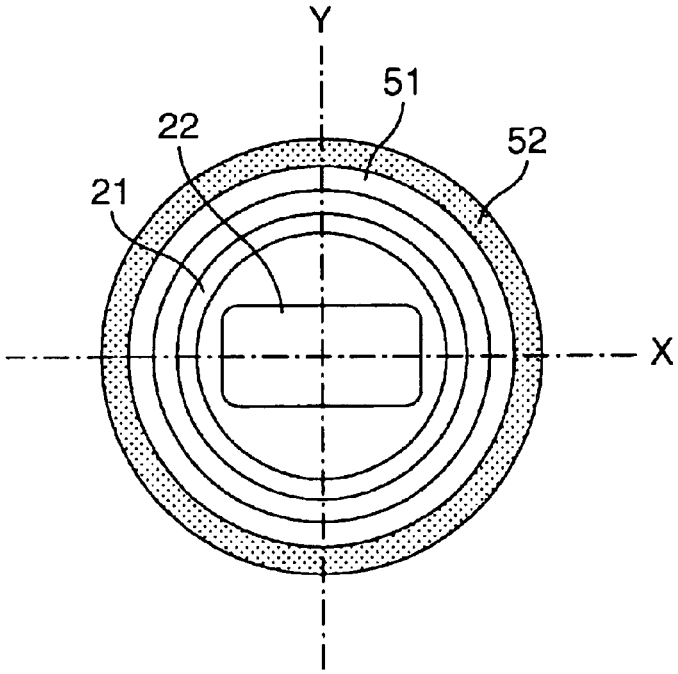
FIG. 2 is a cross-sectional view along line A–A' of the cathode ray tube device.
Figure 3:
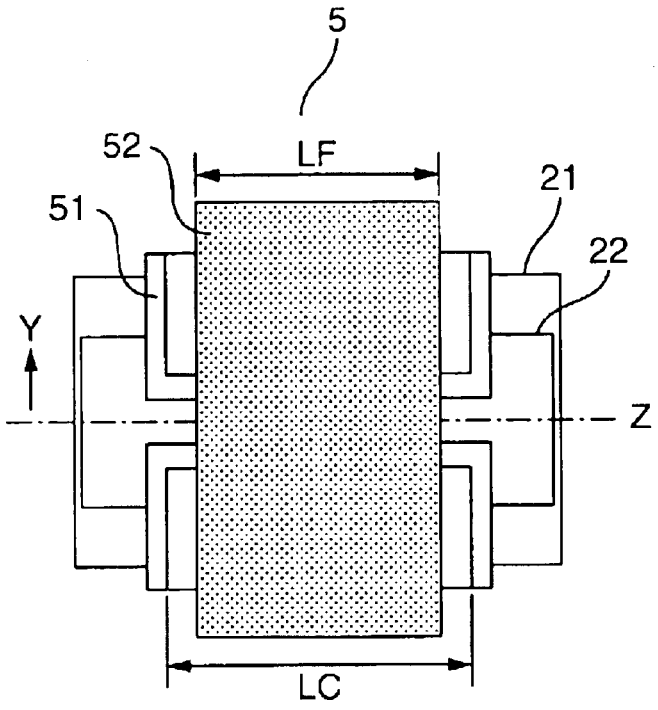
FIG. 3 is a side view of a velocity modulation device according to the present invention.

Now, description will be given of embodiments according to the present invention. First, an embodiment of a velocity modulation device of the present invention will be described by referring to FIGS. 1 to 3. FIG. 1 shows in a side view of a first embodiment of a cathode ray tube device according to the present invention. FIG. 2 shows a cross section taken along line A–A' of the cathode ray tube device shown in FIG. 1. FIG. 3 shows a side view of a primary section of the velocity modulation device. FIGS. 1 to 4 include a cathode ray tube device 1, a cathode ray tube 2, a deflection yoke 3, a convergence yoke 4, a velocity modulation device 5, and an electron gun 6. The electron gun 6 emits a single beam and the beam is converged or focussed using electrostatic focusing to focus the beam by a potential difference between electrodes. The deflection yoke 3, the convergence yoke 4 to primarily correct raster distortion, and the velocity modulation device 5 are separately disposed along a direction from a phosphorescent plane side to a cathode side in this order. Although not shown, the deflection yoke 3 includes a deflection coil to conduct horizontal or vertical scanning and a core including (made of) magnetic material with a high initial permeability of at least 300. Similarly, although not shown, the convergence yoke 4 includes a convergence coil to conduct horizontal or vertical scanning and a core including (made of) magnetic material with a high initial permeability of at least 300. As shown in FIG. 1, the velocity modulation device 5 is disposed at a position on a neck tube 21 on the cathode side relative to the convergence yoke 4. As shown in FIGS. 2 and 3, a velocity modulation coil 51 has a shape of a saddle or a rectangle, and all or part of the entire circumference of the coil 51 is covered with magnetic material 52 including magnetic material.

Figure 5:
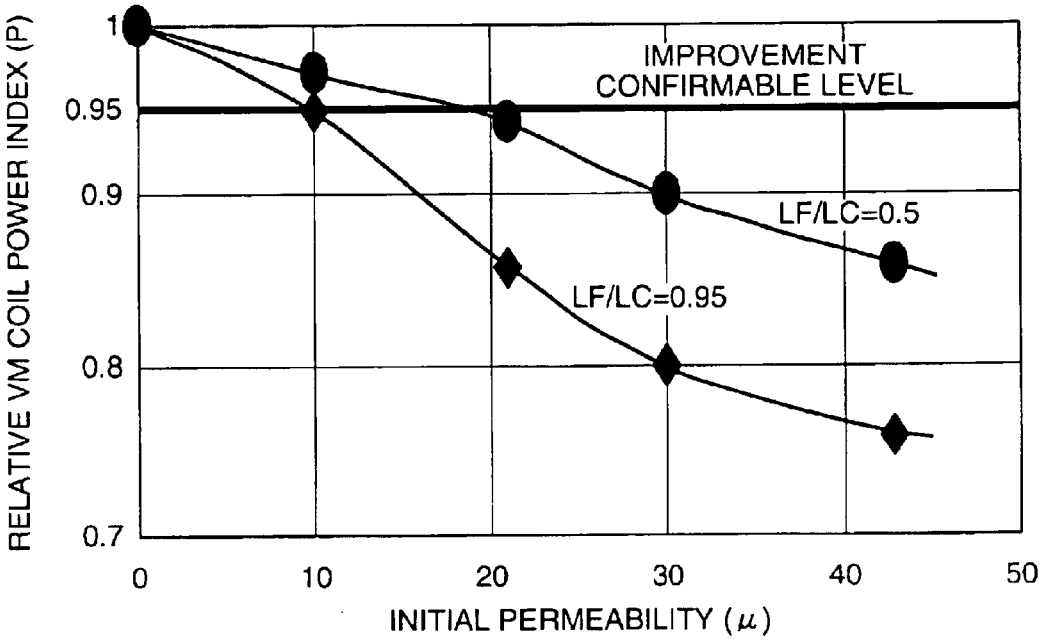
FIG. 5 is a graph showing a characteristic of a velocity modulation device according to the present invention.

FIG. 5 shows actual results of measurement conducted using the embodiment shown in FIG. 3. The abscissa indicates a power index of a relative velocity coil determined by assuming that the power index of the coil is one when the magnetic material 52 is absent. The ordinate indicates the value of the initial permeability of the magnetic material 52 at 2 MHz. The power index of the velocity modulation coil is represented by $L \cdot I^2$ where a current of I and an inductance of L are values required for the velocity modulation coil 51 to deflect a beam spot by 0.5 millimeters (mm) on a tube surface. In FIG. 5, when the power index P of the relative velocity modulation coil is improved by five (5) percent in a visual or personal check, the effect of improvement in sharpness can be confirmed in, for example, a 42-inch projection television set. Therefore, the actual results of measurement shown in FIG. 5 clearly indicate that the sharpness improvement can be confirmed as indicated by an improvement confirmable level when the initial permeability is at least ten. Although the initial permeability is less than 50 in the data shown in FIG. 5, the initial permeability may naturally be 50 or more.

Figure 4:
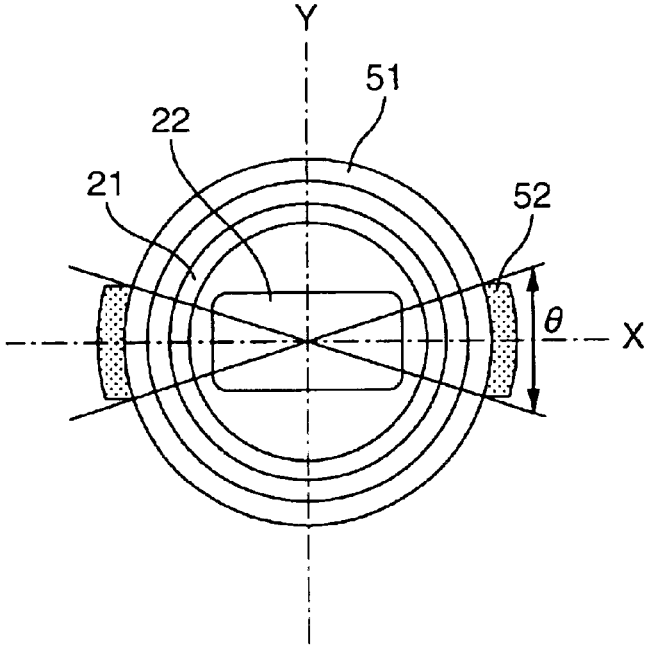
FIG. 4 is a cross-sectional view along line A–A' of the cathode ray tube device.
Figure 6:
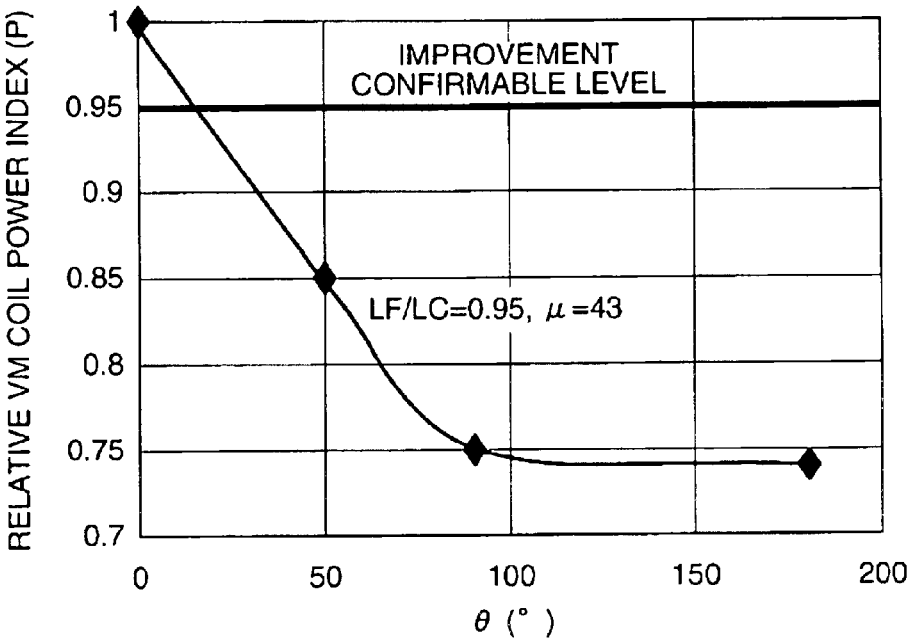
FIG. 6 is a graph showing a characteristic of a velocity modulation device according to the present invention.

The graph of FIG. 6 shows actual results of measurement of the power index of the relative velocity modulation coil with respect to an attachment angle θ of the magnetic material 52 of FIG. 4. From the graph of the actual measurement results of FIG. 6, it can be seen that when the attachment angle θ of the magnetic material 52 is 15° or larger, the sharpness improvement confirmable level can be attained. In FIG. 3, it is not required that the magnetic material 52 is arranged at a central position of the velocity modulation coil 51 in the z-axis direction but may be disposed at a position shifted from the central position.

Although FIG. 4 includes a pair of magnetic material units 52 symmetrically arranged with respect to the x axis, two or more pairs of magnetic material units 52 may be disposed.

Figure 7:
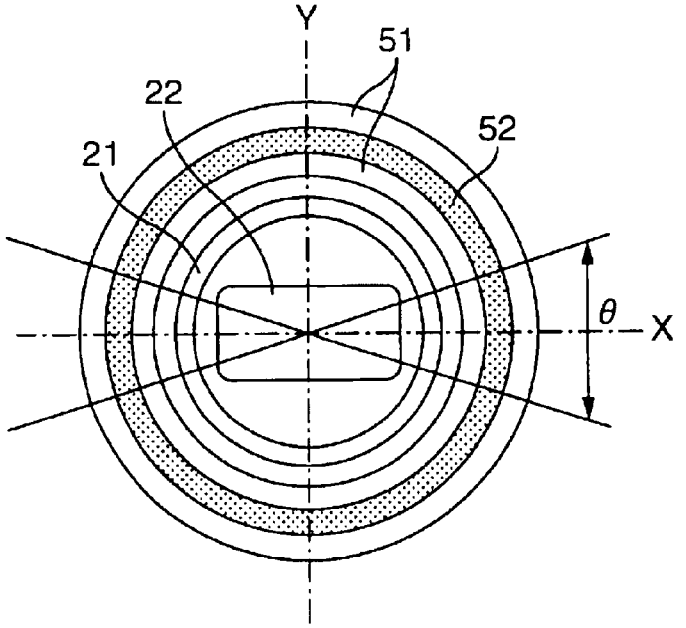
FIG. 7 is a cross-sectional view along line A–A' of another embodiment of a cathode ray tube device according to the present invention.

FIG. 7 shows a cross section taken along line A–A' of another embodiment of a cathode ray tube device according to the present invention. The constituent components of FIG. 7 having the same reference numerals as those of FIG, 2 have almost the same functions of the associated components of FIG. 2. In FIG. 7, the velocity modulation coil 51 is toroidally wound on the magnetic material 52 according to one aspect of the present invention. Although the coil 51 is arranged on almost the entire circumference of the magnetic material 52, it is not required to dispose the coil 51 on the entire circumference of the magnetic material 52. That is, the magnetic material 52 may be disposed with an angle of θ with respect to the x axis, and the coil 51 may be distributively arranged in a distribution in which the density of distribution is smaller or zero in a central section of the coil 51. Particularly, the inductance L cannot take a large value due to a voltage value limit of a driving circuit and the value of inductance L per turn is large. Therefore, it is difficult to precisely or finely adjust the inductance L. When the velocity modulation coil 51 is arranged with an appropriate distribution with respect to angle θ, the inductance can be precisely or finely adjusted even if the coil 51 has the same number of turns. The magnetic material 52 of the present invention may be a mixture of, for example, soft ferrite and nonmagnetic material as biding material of the soft ferrite. In this case, a complicated shape can be obtained at a low cost. When a nonmagnetic material such as, for example, resin like gum (gum-based resin) is used, the resultant material is flexible and hence can be advantageously used to easily construct the magnetic material 52 in a curved shape. Similarly, although the magnetic material 52 covers the entire circumference, it is not required to completely cover the entire periphery. The material 52 may be arranged in a shape having angle θ.

According to the present invention, the magnetic material 52 shields the leakage magnetic field and the leakage electric field from the velocity modulation device 5. Therefore, advantageously, the noise from the cathode ray tube device 1 can be remarkably reduced. The cathode ray tube device 1 of the present invention explained above is configured, for example, as a projection tube to emit a single beam. However, it is to be appreciated that the advantage can be obtained even if the cathode ray tube device 1 is a cathode ray tube device including an electron gun using an electrostatic focusing electron gun of, for example, a color Braun tube to emit a plurality of electron beams and a deflection yoke to deflect the electron beams.

Figure 8:
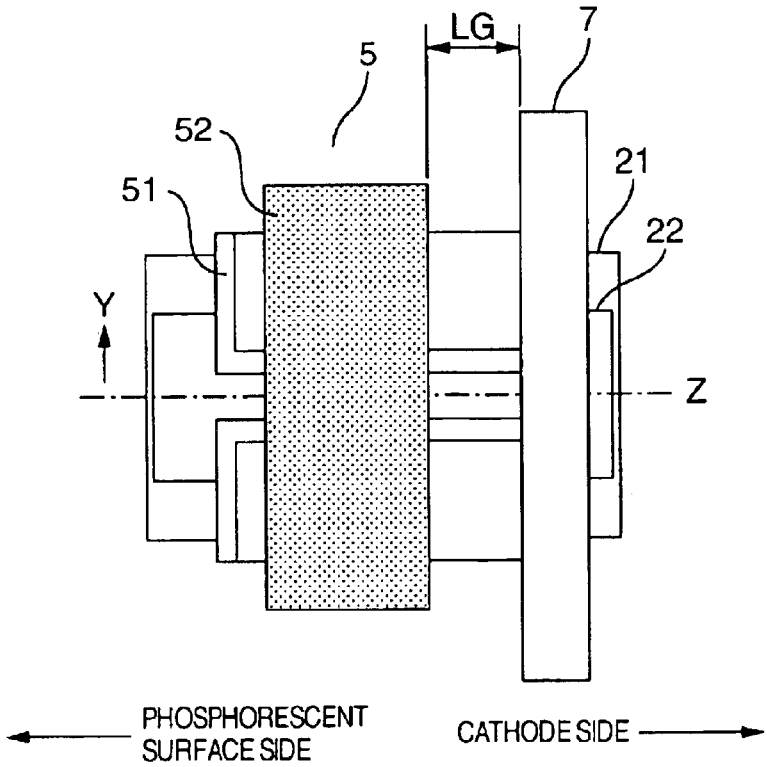
FIG. 8 is a side view of another embodiment of a cathode ray tube device according to the present invention.
Figure 9:
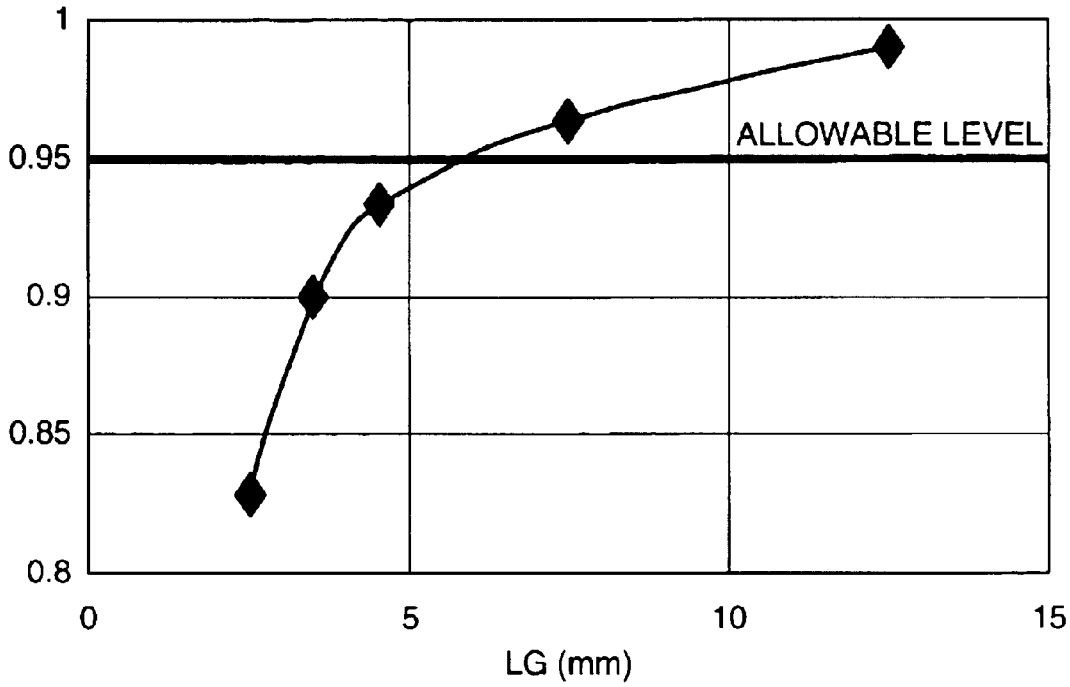
FIG. 9 is a graph showing a characteristic of the embodiment of FIG. 8.

FIG. 8 shows an embodiment of the present invention in which a magnet device 7 including a two-pole, four-pole, or six-pole magnet to align a beam and/or to adjust the shape of the beam is arranged in the neighborhood of the velocity modulation device 5 according to the present invention. In this configuration, the magnetic material 52 shields an auxiliary (correction) magnetic field from the magnetic device 7 and hence the amount of correction from the magnetic device is reduced. FIG. 9 is a graph of a characteristic of the embodiment of FIG. 8, and specifically shows a relationship between a gap LG between the magnet device 7 and the magnetic material 52 and relative beam displacement of a two-pole magnet of the magnet device 7 on the phosphorescent plane. The ordinate indicates normalized beam displacement of the two-pole magnet on the phosphorescent plane when the magnetic material 52 is absent. No problem occurs if the normalized beam displacement is equal to or more than 0.95. This graph clearly indicates that the gap LG between the magnet device 7 and the magnetic material 52 is at least 6 millimeters for normal operation. Although this characteristic graph is obtained when the magnet device 7 is disposed on the cathode side, almost the same result can be obtained even when the magnet device 7 is arramged on the phosphorescent plane side. The advantage described above is obtained when the electron beam is deflected mainly in the horizontal direction by the velocity modulation device. However, the similar advantage can be obtained even when the velocity modulation device of the present invention is rotated 90° to deflect the beam in the vertical direction. The cathode ray tube device of the present invention is applicable to a television set of projection type or a television set of ordinary type to be watched directly by a human and is, in particular, efficiently applicable to a high-definition television set and a power-saving television set.

As above, there can be produced according to the present invention a velocity modulation device, a cathode ray tube device using the same, and a television set using the same in which the sensitivity of the velocity modulation device is increased using quite a simple configuration and in which noise such as a leakage magnetic field and a leakage electric field from the velocity modulation device is reduced to thereby minimize the consumption power consumed by the device.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A cathode ray tube device, comprising:

a cathode ray tube including an electron gun operating using electrostatic focusing;

a main deflection yoke and an auxiliary deflection yoke which are attached to the cathode ray tube separately in a direction of a tube axis of the cathode ray tube, the main deflection yoke primarily deflecting an electron beam, the auxiliary deflection yoke correcting raster distortion; and a velocity modulation device disposed on a cathode side of the auxiliary deflection yoke, the velocity modulation device including a velocity modulation coil to modulate scanning beam velocity, all or part of a circumference of the velocity modulation coil being covered with material having an initial permeability of at least 10 at 2 MHz.

2. A cathode ray tube device according to claim 1, wherein the velocity modulation coil has a shape of a saddle.

3. A cathode ray tube device, comprising:

a cathode ray tube including an electron gun operating using electrostatic focusing;

a main deflection yoke and an auxiliary deflection yoke which are attached to the cathode ray tube separately in a direction of a tube axis of the cathode ray tube, the main deflection yoke primarily deflecting an electron beam, the auxiliary deflection yoke correcting raster distortion; and a velocity modulation device disposed on a cathode side of the auxiliary deflection yoke, the velocity modulation device including a core and a velocity modulation coil to modulate scanning beam velocity, the coil being toroidally wound over the core, the core including material having an initial permeability of at least 10 at 2 MHz.

4. A cathode ray tube device, comprising:

an electron gun operating using electrostatic focusing;

a deflection yoke for deflecting an electron beam from the electron gun; and a velocity modulation device disposed on a cathode side of the deflection yoke, the velocity modulation device including a velocity modulation coil to modulate scanning beam velocity, all or part of a circumference of the velocity modulation coil being covered with material having an initial permeability of at least 10 at 2 MHz.

5. A cathode ray tube device, comprising:

an electron gun operating using electrostatic focusing;

a deflection yoke for deflecting an electron beam from the electron gun; and a velocity modulation device disposed on a cathode side of the auxiliary deflection yoke, the velocity modulation device including a core and a velocity modulation coil to modulate scanning beam velocity, the coil being toroidally wound over the core, the core including material having an initial permeability of at least 10 at 2 MHz.

6. A cathode ray tube device according to claim 1, wherein the velocity modulation coil is covered with the material at an angle of at least 15° with respect to an x-axis.

7. A cathode ray tube device according to claim 1, wherein the material is separated from the two-pole, four-pole, or six-pole magnet with a gap equal to or more than 6 millimeters.

8. A cathode ray tube device according to claim 1, wherein the material having the initial permeability of at least 10 includes a mixture of a magnetic material and a resin.

9. A television set including a cathode ray tube device according to claim 1.

* * * * *